US011382440B2

(12) United States Patent
McKeever

(10) Patent No.: US 11,382,440 B2
(45) Date of Patent: Jul. 12, 2022

(54) CUBOCTAHEDRAL TRANSPARENT THERMOPLASTIC IMAGE AND OBJECT DISPLAY

(71) Applicant: James Carl McKeever, Union City, NJ (US)

(72) Inventor: James Carl McKeever, Union City, NJ (US)

( * ) Notice: Subject to any disclaimer, the term of this patent is extended or adjusted under 35 U.S.C. 154(b) by 266 days.

(21) Appl. No.: 16/602,122

(22) Filed: Aug. 8, 2019

(65) Prior Publication Data

US 2020/0069084 A1 Mar. 5, 2020

Related U.S. Application Data

(60) Provisional application No. 62/765,504, filed on Aug. 30, 2018.

(51) Int. Cl.
*A47G 1/14* (2006.01)

(52) U.S. Cl.
CPC ..... *A47G 1/141* (2013.01); *A47G 2001/145* (2013.01)

(58) Field of Classification Search
CPC ..... A47G 1/141; A47G 2001/145
See application file for complete search history.

(56) References Cited

U.S. PATENT DOCUMENTS 4,723,382 A * 2/1988 Lalvani ..... E04B 1/3211 273/157 R
2002/0058456 A1* 5/2002 Miller ..... A63H 33/084 446/85

FOREIGN PATENT DOCUMENTS

DE 2252055 A1 * 5/1974 ..... A47G 1/14
FR 2904970 A1 * 2/2008 ..... A47G 1/141

* cited by examiner

*Primary Examiner* — Christopher R Harmon

(57) ABSTRACT

A cuboctahedron-shaped photo cube, comprised of six identically folded sheets of strong, but flexible transparent thermoplastic, assembled to allow the display of six two or three dimensional pieces of art or other objects. Each sheet has a square area, serving as a display panel and is accompanied by a backing sheet to press two-dimensional art firmly against it. Users access the interior by pulling a sheet from the structure. Art or objects are then placed inside the unit. To replace the removed sheet, one of its winged tabs is pinched with a thumb and forefinger and inserted into one of the available slots on the structure until it snaps into place. This action is repeated for the remaining aligned tabs and slots. The purpose of this invention is to present six display panels simultaneously without any being placed on the bottom, hidden from the viewer.

1 Claim, 5 Drawing Sheets

CUBOCTAHEDRAL TRANSPARENT THERMOPLASTIC IMAGE AND OBJECT DISPLAY

CROSS-REFERENCE TO RELATED APPLICATIONS

Application No. 62/765,504
Filing of 371(c) Date: Aug. 30, 2018

STATEMENT REGARDING FEDERALLY SPONSORED RESEARCH OR DEVELOPMENT

Not Applicable

BACKGROUND OF THE INVENTION

This invention relates to image and object display units. It should be considered in the categories of picture frames and photo cubes for two-dimensional items and keepsake, memorabilia and product displays for three-dimensional items. There is a wide variety of products marketed for the presentation of photographs, illustrations, advertisements and three-dimensional objects. Consumers often seek the most interesting and unique items in this area. The novelty in this invention is its ability to display art in a three-dimensional apparatus that is unique in shape and method used for removing and replacing items from its interior.

The item to which this application pertains is not of a new shape. It is an Archimedean solid originating over two millennia ago. The cuboctahedron is comprised of six squares and eight triangles. The deviation of the basic shape in this invention is that each of the triangular areas is inverted into the unit and further divided by three triangular areas. The basic method for the folding and assembly of the sheets is not novel either: the instructions are shared by many origami artists using a variety of materials from construction paper to business cards and transportation fare cards.

BRIEF SUMMARY OF THE INVENTION

The purpose of this display unit is to contain either two-dimensional art or to house wrapped food items or other three-dimensional objects. The unit is intended to be placed in any location that a picture frame with a stand or a common photo cube would be displayed, such as a table, shelf, dresser or office desk. Other intended uses are as display units on utility structures in commercial environments, such as a writing stand in a bank lobby for the purpose of displaying ads for financial services; containers and display units for party favors for social gatherings such as weddings and bar mitzvahs.

This invention, unlike other cube displays, is able to function without one of the six display panels positioned on the bottom of the unit, obscuring it from view. It also does not require rotation with one of its corners to be placed in or on a stand, providing only 45-degree rotated panels to display imagery or objects. It simultaneously allows for the full display of six square areas of imagery and/or objects that do not need to be rotated to a diamond-shape format.

DETAILED DESCRIPTION OF THE INVENTION

There are several aspects to this invention that distinguish it from earlier opaque origami objects. The most significant being the usage of this design due to type of material that allows the unit to display two-dimensional art 70 or three dimensional objects in a strong, transparent structure.

Figure 3:
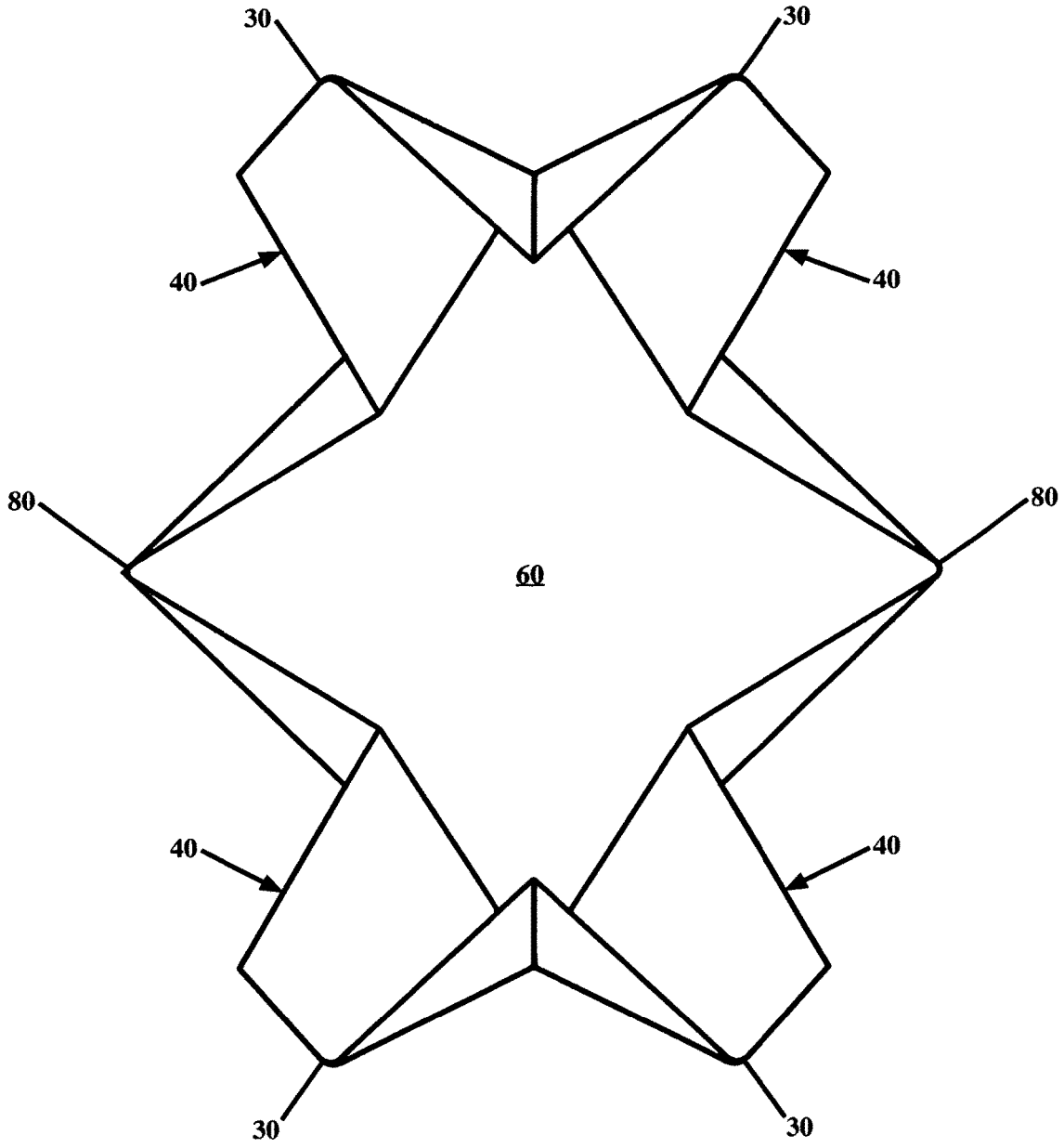
FIG. 3 is a three-dimensional view of the interior of a frame sheet removed from the unit.
Figure 4:
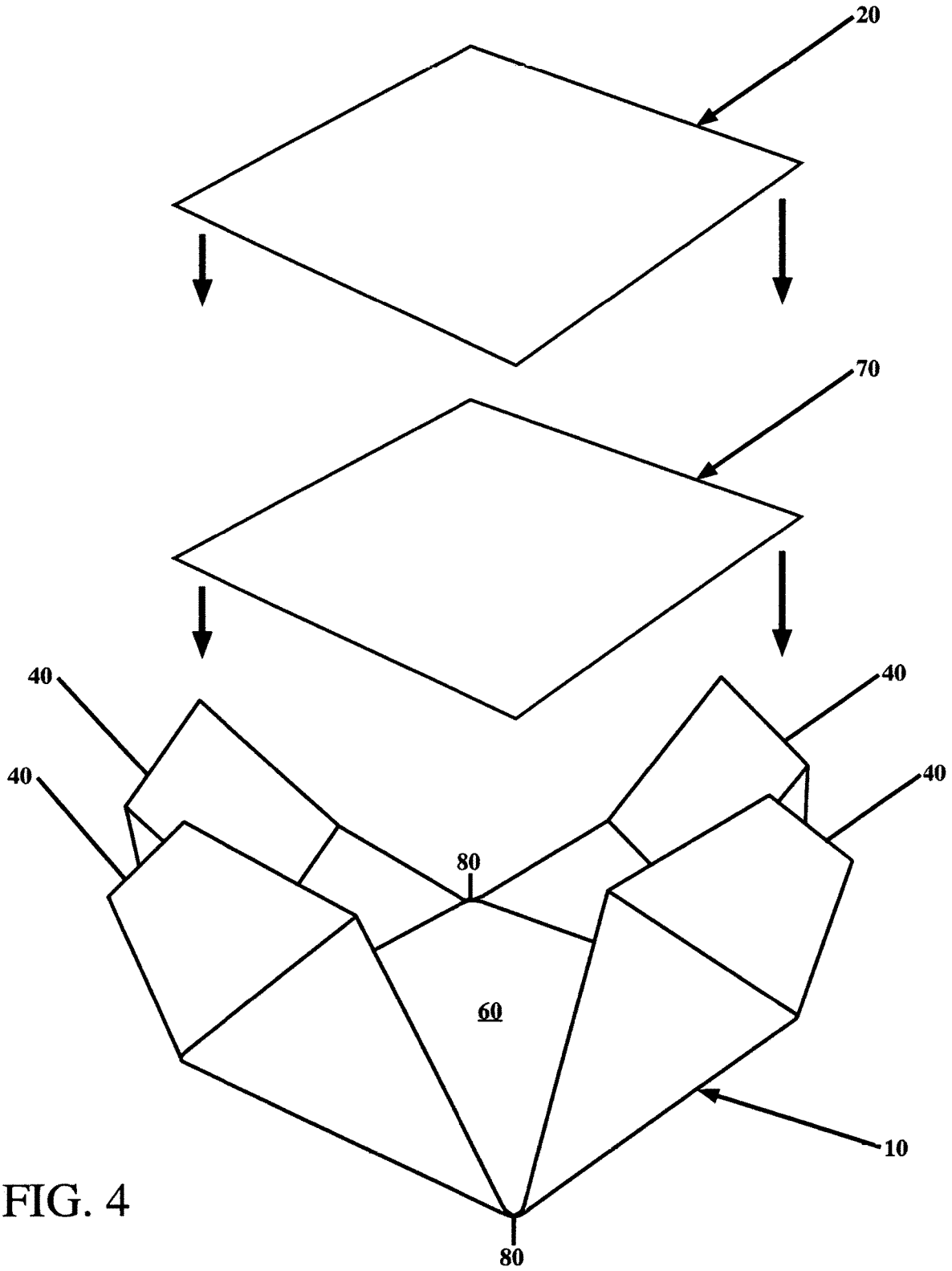
FIG. 4 is a perspective view of two-dimensional art and a backing sheet aligned with a frame sheet.

The material consists of completely transparent thermoplastic frame sheets 10 (referenced in FIG. 3) that are 5" wide×8" high×0.02" thick, before manufactured folds are made. The thickness is thin enough to allow for ease in cutting and folding by the manufacturer, but is thick enough to provide extreme durability for its structure once the unit is assembled.

Figure 1:
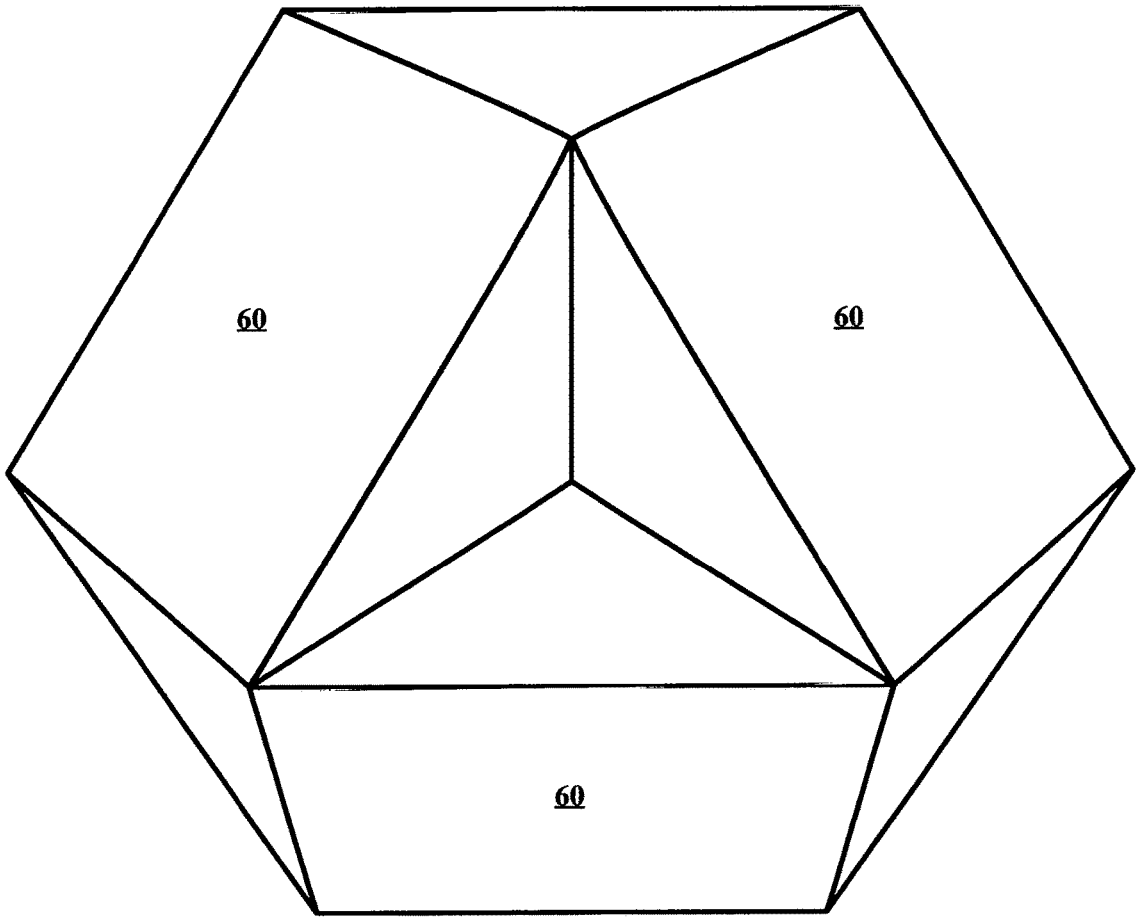
FIG. 1 is a perspective view of the assembled unit as it is placed on a surface with one of its triangular sides on the bottom.

Reference is made first to FIG. 1, which provides a perspective view of a fully assembled structure of the present invention.

There are six square sheets provided that are of the same aforementioned material that serve as backing sheets 20 (to press images 70 flat against the display panels 60) and are also to be used as templates for cutting two-dimensional art 70 to fit the display panels 60.

There are rounded corners 30 on the winged tabs 40. Each of the two winged tabs 40 of each of the frame sheets 10 are rounded to prevent them from scratching the surface of the display panel 60 of the adjacent sheet as they are inserted into its slot 80.

The dimension for the width of the space between the two flaps that comprise each of the two slots 80 on each frame sheet 10 is wider than the width used in standard origami models (which have the two flaps touching). This space is exactly the amount to allow for the thickness of the four layers of the adjacent frame sheet's 10 winged tabs 40 (which are significantly thicker than conventional models due to the thickness of the material) as well as provide for a stable fitting of the two frame sheets 10.

A box 110 measuring ½" larger in width than the unit is provided that holds the unit together while a frame sheet 10 is removed for two-dimensional art 70 placement. The box 110 is not entirely necessary for users who possess good hand skills, however, without the containment provided by the box, the unit can become unstable and fall apart if the user is unable to hold it together while removing or replacing a frame sheet 10.

Basic Instructions for Use

The user of the display unit will remove a frame sheet 10 from the unit and either place cut-to-size two-dimensional art 70 into the center display panel 60 or fill the interior of the unit with small three-dimensional items of their choice and then replace the frame sheet 10.

Figure 2A:
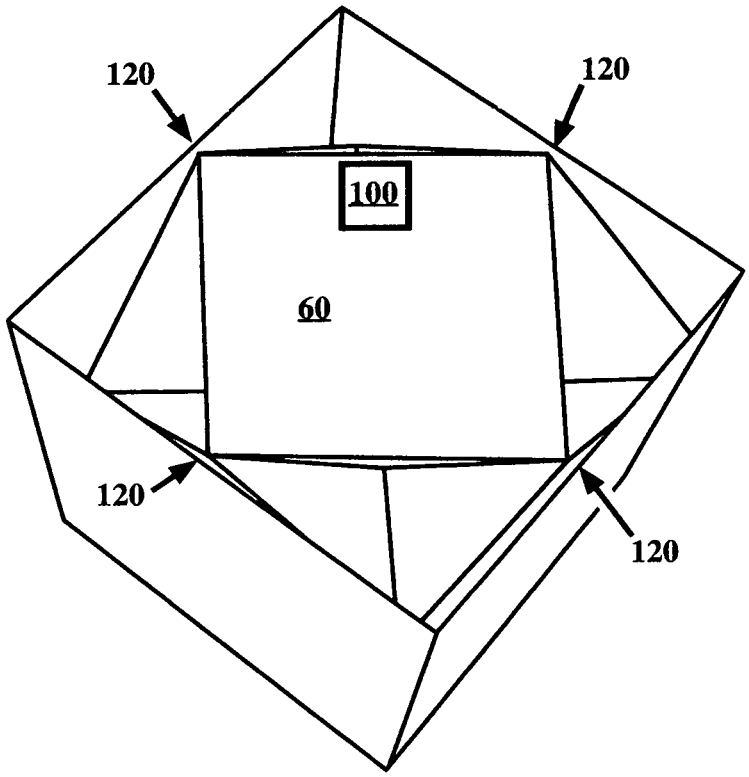
FIG. 2A is a perspective view of the assembled unit placed in the provided box with a display panel at the top.
Figure 2B:
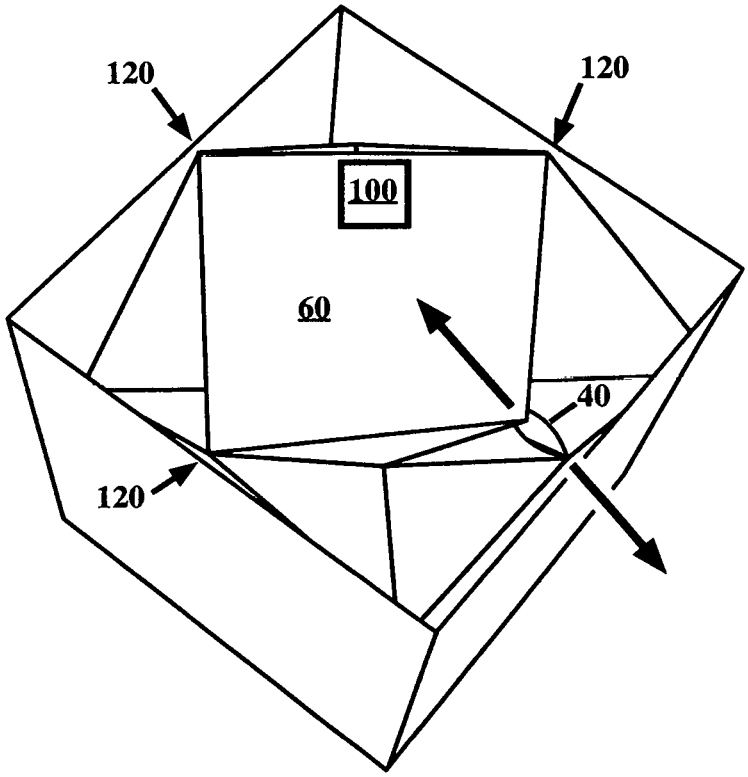
FIG. 2B is the unit in FIG. 2 with the frame sheet in the process of removal from the rest of the unit.

To open the unit, the user will locate any two inverted triangular spaces adjacent to each other. The user will place forefingers of both the left and right hands into the space furthest from the user and thumbs from the left and right hands into the other space. The user will then pull in the two opposite directions (see directional arrows in FIG. 2B) until the closest end of the frame sheet 10 which is to have its two-dimensional art 70 replaced is dislodged. The user will then completely remove the frame sheet 10 from the rest of the unit.

The unit includes six 3½" square sheets (made of the same material as the unit). These will be used as backing sheets 20, similar to backing panels used in traditional frames to press imagery firmly against the glass front. These sheets will also be used for tracing (with any writing instrument) a square line onto two-dimensional art 70, which is to delineate the portion that is to appear in the display panel 60. Once this line is drawn, the user will then use scissors or other type of blade to trim away and discard the extraneous portion of the two-dimensional art 70. It is then placed into the display panel 60 of the removed frame sheet 10 and held into place by the folds adjacent to the display panel. It can be further reinforced with the backing sheet 20, although if the material on which the two-dimensional art 70 appears is rigid, the backing sheet 20 will not be necessary.

Before a frame sheet 10 is removed from the unit, the user will mark the top edge of its display panel 60 with the provided sticker 100 and, when inserting the two-dimensional art 70, place its top edge along the marked edge of the display panel 60. This will insure that when fully assembled, the unit displays all two-dimensional art 70 at the correct degree of rotation.

Figure 5:
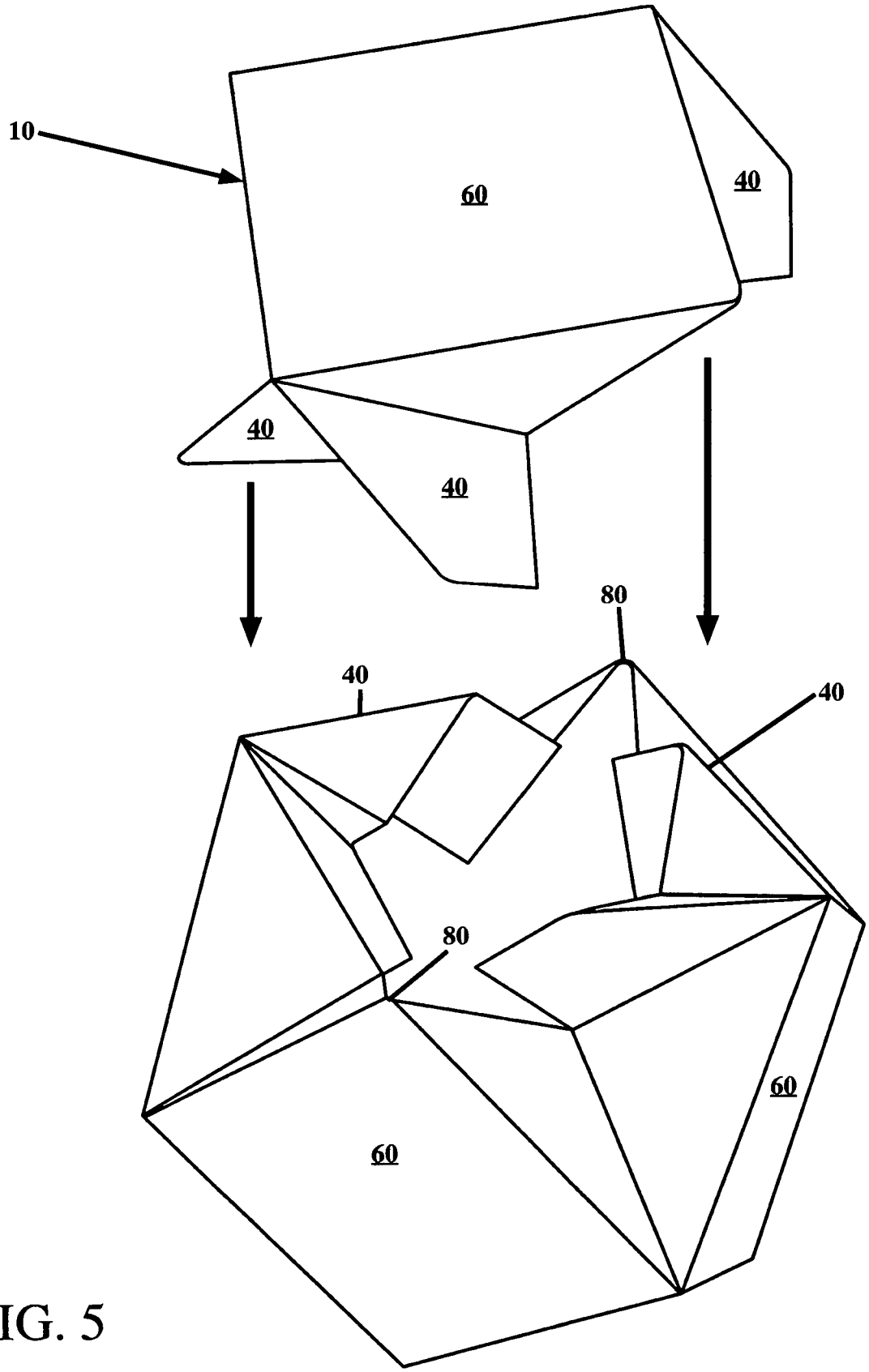
FIG. 5 is a perspective view of the display panel sheet aligned with the remainder of the cube into which it will be placed.

To replace the frame sheet 10, the user will position it above the unit so that its winged tabs 40 line up with the slots 80 on the perimeter of the open area of the unit (see directional arrows in FIG. 5). Each frame sheet 10 has two winged tabs 40, which are opposite each other, and two slots 80, also opposite each other. The wings of one of the winged tabs 40 of the removed frame sheet 10 will be pinched together and inserted into an open slot 80 of a frame sheet 10 in the unit until it snaps and self-clamps firmly into place. The user will then connect the remaining three sets of tabs 40 and slots 80. The user will need to ensure the two-dimensional art 70 is at the correct degree of rotation while inserting its frame sheet 10 into the unit, so that it will not appear rotated ninety degrees right or left or upside down. This is achieved by aligning either its top right corner to the top left corner of two-dimensional art 70 to its immediate right, already placed in the unit, or its top left corner to the top right corner of two-dimensional art 70 to its immediate left.

The unit can be completely disassembled and reassembled (taking apart all six frame sheets 10), however reassembly from that state requires a certain amount of hand skills to do so. This is why it is strongly recommended that the user keep the unit in the supplied box 110 while removing only one frame sheet 10 at a time and replacing it before removing the unit from the box 110, rotating it and then removing the next sheet, if desired. This box 110, which has five sides (the top side is open) will hold the unit loosely, but sufficiently in place so it does not accidentally fall apart during the replacement process. The space 120 between the outer edges of the unit and the inner edges of the box 110 will allow the unit to be pulled apart only enough for the user to remove the frame sheet 10 positioned on the top side, but not so much that the unit will come apart, requiring extensive reassembly.

Although the invention described has been represented in preferred embodiments, the preceding description is given only for elucidation, and should not be considered as a limitation of the invention. Modifications to structure, size, and the specific arrangement of components, where such modifications are coincidental to the environment or the specific subject matter being displayed, do not necessarily depart from the spirit and scope of the invention.

The invention claimed is:

1. A photo cube, configured to house and display two and three-dimensional items within comprising:

six semi-rigid, transparent plastic sheets identically folded and assembled together forming a cuboctahedron with tabs comprising rounded corners and triangle-shaped slots;

six additional semi-rigid square plastic sheets configured for press insertion with two-dimensional art against the display surface within the cube, allowing the art to be displayed clearly.

* * * * *